United States Patent [19]

Wolf

[11] 4,317,482

[45] Mar. 2, 1982

[54] METHOD FOR PREVENTING DAMAGE TO STRAND GUIDE ELEMENTS OF A CONTINUOUS CASTING INSTALLATION FOR STEEL

[75] Inventor: Manfred Wolf, Zurich, Switzerland

[73] Assignee: Concast AG, Zurich, Switzerland

[21] Appl. No.: 262,036

[22] Filed: May 11, 1981

Related U.S. Application Data

[63] Continuation of Ser. No. 60,686, Jul. 25, 1979, abandoned.

[30] Foreign Application Priority Data

Aug. 11, 1978 [CH] Switzerland ..... 8558/78

[51] Int. Cl.[3] ..... B22D 11/16

[52] U.S. Cl. ..... 164/454; 164/413

[58] Field of Search ..... 164/454, 154, 413, 442, 164/448, 484

[56] References Cited

U.S. PATENT DOCUMENTS

| | | | |
|---|---|---|---|
| 3,025,579 | 3/1962 | Littlewood | 164/154 |
| 3,040,397 | 6/1962 | Haussner et al. | 164/154 |
| 3,047,915 | 8/1962 | Barnard et al. | 164/413 |
| 3,321,008 | 5/1967 | Jones | 164/413 |
| 3,861,456 | 1/1975 | Gallucci et al. | 169/413 |
| 4,030,531 | 6/1977 | Wunnenberg et al. | 164/454 |
| 4,148,349 | 4/1979 | Sumita et al. | 164/413 X |

*Primary Examiner*—Gus T. Hampilos

*Attorney, Agent, or Firm*—Werner W. Kleeman

[57] ABSTRACT

A method for preventing damage to the strand guide elements of strand guide arrangements or roller aprons of a continuous casting installation for metals, especially steel, wherein it is possible to withdraw a strand which is immobile in the strand guide arrangement or roller apron, by means of a powerful withdrawal unit, without the risk of damaging elements of the strand guide arrangement. At pre-selected locations of the strand guide arrangement there are determined the withdrawal forces effective at such locations and acting upon the elements of the strand guide arrangement. Upon exceeding maximum permissible values the strand withdrawal operation is interrupted.

4 Claims, 1 Drawing Figure

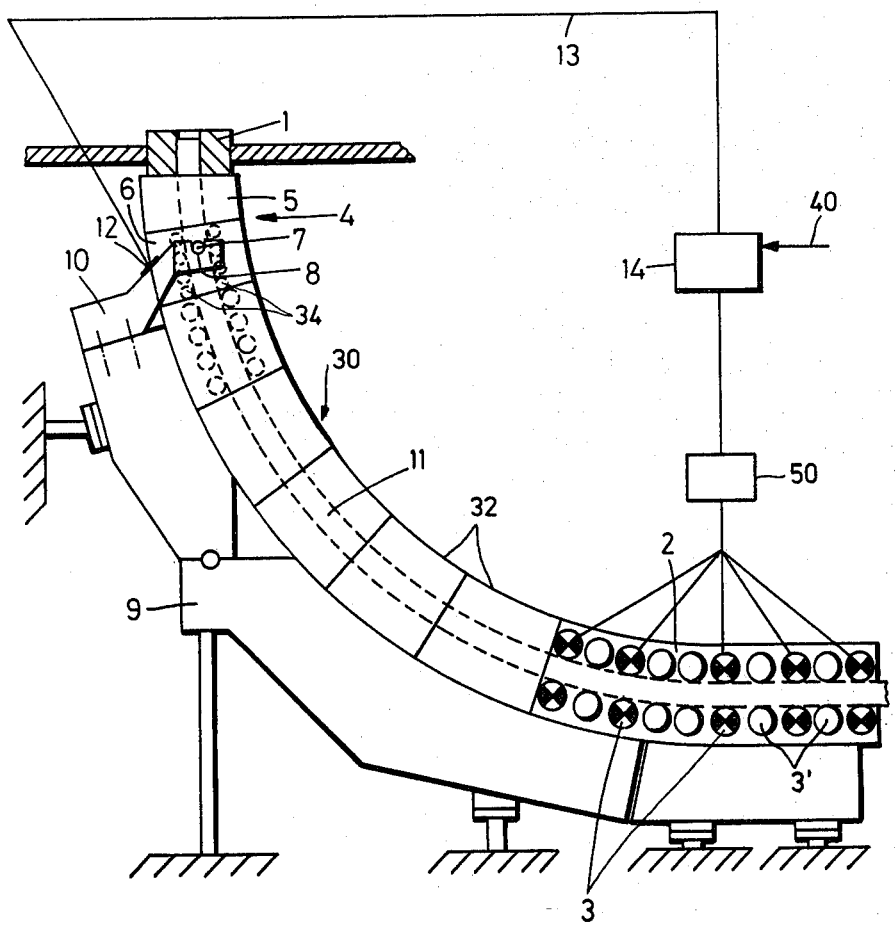
13
1
6
5
4
12
7
10
8
34
30
40
14
11
50
32
2
9
3'
3

METHOD FOR PREVENTING DAMAGE TO STRAND GUIDE ELEMENTS OF A CONTINUOUS CASTING INSTALLATION FOR STEEL

CROSS REFERENCE TO RELATED APPLICATION

This is a continuation application of my commonly assigned, U.S. application Ser. No. 06/060,686, filed July 25, 1979, now abandoned.

BACKGROUND OF THE INVENTION

The present invention relates to a new and improved method of preventing damage to the strand guide or roller apron elements of a continuous casting installation for metals, especially steel.

During the continuous casting of steel it sometimes happens that there arises undesired deformation of the strand, predominantly when operational disturbances of the continuous casting installation require interruption of the casting operation. If such shutdown of the casting operation is over a prolonged period of time, then the still thin strand shell or skin, due to inadequate strength, is not capable of withstanding the ferrostatic pressure of the liquid strand core or sump along unsupported sections of the strand, for instance, between pairs of guide rolls. In such case the strand shell or skin tends to bulge. If too great a time interval transpires until start-up of the continuous casting installation, during which time interval the solidification of the strand continues, then frequently it is no longer possible to again push back such bulged portions against the resistance of the partially solidified strand, by means of the guide rolls. Consequently, during the withdrawal of the strand it can bind or remain stuck between the guide rolls. This phenomenon is associated with overloading of such guide rolls and the elements of the support structure, and with constant withdrawal force, can lead to deformation or destruction thereof.

A further disturbance in the normal casting operation, which cannot always be avoided, is metal break-out, at least at a region of the first peripherally solidified strand directly below the mold. As a general rule there are associated therewith undesirable phenomena, since frequently a large quantity of steel outflows into the secondary cooling zone, solidifying at the parts of the installation located thereat, such as the support and guide rolls, the elements of the support structure and so forth. When this happens there almost always occurs appreciable damage requiring expensive repair work. The phenomenon of metal break-out, in the most general situations, requires interruption of the continuous casting operation.

The consequences of such shutdown of the continuous casting operation, apart from the time-consuming elimination of the direct cause of the metal break-out, usually resides, in particular, that there arise irreparable deformations of the strand guide rolls. Such is caused by one-sided, local overheating of the rolls which come into contact with the stationary, hot strand or casting. Upon restarting of the continuous casting installation, especially upon again placing into operation the strand guide arrangement, such roll deformations can result in out-of-true rotation of the rolls, and furthermore, due to irregular loading of the bearings of the rolls or rollers such can cause destruction of such roll bearings or roll fracture. Moreover, out-of-true running of the guide rolls, due to deformation of oppositely situated rolls in the same sense, can result in the periodic application of irregular forces at the strand. At locations of intensified pressure there can arise the phenomenon that the strand will be rolled or reduced, associated with undesirable fissure formations at the strand.

In practice attempts are made to avoid the above-explained disadvantages which arise upon interruption of the strand withdrawal operation, by performing the following technique. Upon interruption of the infeed of the molten steel to be cast into the continuous casting mold, then the strand is completely withdrawn by means of large dimensioned withdrawal units without interruption, against the forces hindering the withdrawal of the strand. These obstructing forces result from irregularly formed strands or strands which have welded together with parts of the continuous casting installation. When carrying out this procedure it can happen that, owing to the presence of extremely strong welding of the strand with the roller apron elements, such as the rolls, grids and so forth, and which welds can no longer be broken by simply being torn-away during the process of withdrawing the strand, the large withdrawal forces tend to act directly upon the support and bearing elements of the strand guide arrangement or roller apron. Upon overloading of such support and bearing elements of the strand guide arrangement permanent deformation and damage thereto can arise.

Thus, for instance, if a so-called first zone of the strand guide arrangement or roller apron is cast due to overflowing steel, the aforementioned overloading can result in an undesirable deformation of the support arms and the support journals of the first zone, and thus, can lead to deviations in the geometry of the strand guide arrangement or roller apron. This, in turn, requires expensive, time-consuming repair work. An advantage of the above-described method, which strives to prevent stoppage of the strand in the presence of a metal break-out, in contrast to conventional casting techniques where the strand is allowed to cool, therefore is no longer realized when such situation occurs. Deviations in the geometry of the strand guide arrangement, which cannot be immediately detected, moreover lead to the formation of fissures at the cast strand or casting, and thus, reduce the quality of the cast strand.

SUMMARY OF THE INVENTION

Therefore, with the foregoing in mind it is a primary object of the present invention to provide a new and improved method of preventing damage to strand guide elements of a continuous casting installation for metals, especially steel, which is not afflicted with the aforementioned drawbacks and shortcomings of the prior art as discussed above.

Still a further significant object of the present invention aims at avoiding the above-explained drawbacks, while utilizing the technique of outfeeding a strand experiencing metal break-out without interrupting the strand withdrawal operation, and furthermore, avoiding the drawbacks which prevail, as likewise explained above, during withdrawal of a strand which has bulged during standstill, particularly the disadvantages associated with a possible overloading of the parts of the continuous casting installation.

Yet a further significant object of the present invention is to prevent, at a continuous casting installation, destruction of guide elements, such as rolls and the like, and deformation of elements of the support structure, leading to deviations in the geometry of the strand guide arrangement, and the therewith associated effects upon the cast product which result in impairment of its quality.

Now in order to implement these and still further objects of the invention, which will become more readily apparent as the description proceeds, the method aspects of the present invention contemplate, during the withdrawal of undesirably deformed strands or strands which have welded at parts of the strand guide arrangement due to spilled-out steel, the determination of, at preselected locations of the strand guide arrangement, the withdrawal forces which are effective thereat. Then, the determined measured values are compared with predetermined, maximum values which avoid damage to the strand guide arrangement, and upon the measured values exceeding the predetermined maximum values there is delivered a command, typically in the form of a control signal or pulse, in order to interrupt the strand withdrawal operation.

With this method there is eliminated the risk of damaging elements of the strand guide arrangement by overloading the same. It is possible to employ large dimensioned withdrawal units for withdrawing a strand which is immobile at the strand guide arrangement or tends to jam, while avoiding any overloading or endangered parts of the continuous casting installation. The withdrawal force of such withdrawal unit can be immediately adjusted and free of risk to the maximum possible value which is coordinated with the maximum permissible loading factor of the loaded material. There is rendered possible a dynamic, if required even a staggered or repeated surge-like strand withdrawal which favors breaking-away of a strand which has been welded to parts of the continuous casting installation.

However, if there is prevented any breaking-away of the strand because it is too strongly welded to parts of the continuous casting installation and if there have been exceeded the predetermined maximum values, then there is delivered a command pulse for interrupting the withdrawal operation. The strand welding phenomenon, hindering the strand withdrawal operation, in such case is manually eliminated as quickly as possible, through the use of suitable devices, and then there is continued with the strand withdrawal operation. Since there is avoided cooling of the strand which would render impossible normal strand outfeed, there are beneficially avoided complicated measures for freeing the strand guide arrangement for renewed operation, such as cutting of the strand by flame or torch cutters and so forth. The consequences of metal break-out are eliminated much more rapidly and there is significantly reduced the time needed until the continuous casting installation is again ready to be placed into operation.

According to an advantageous feature of the inventive method, there are measured the stresses arising at the support arm of the first zone.

BRIEF DESCRIPTION OF THE DRAWING

The invention will be better understood and objects other than those set forth above, will become apparent when consideration is given to the following detailed description thereof. Such description makes reference to the annexed drawing wherein the single FIGURE of the drawing schematically illustrates a continuous casting installation constructed for practicing the teachings of the method aspects of the present invention.

DETAILED DESCRIPTION OF THE PREFERRED EMBODIMENTS

Describing now the single FIGURE of the drawing, it is to be understood that as a matter of convenience in illustration, there has only been shown enough to the structure of the continuous casting installation to enable those skilled in the art to readily understand the underlying principles and concepts of the present development. Hence, the continuous casting installation, shown by way of example in the drawing, will be seen to comprise an open-ended mold 1 following which there is arranged an arc-type or curved strand guide arrangement, generally indicated by reference character 30. This strand guide arrangement or roller apron 30 is divided into individual segments 32 as is well known in the continuous casting art. Following the strand guide arrangement 30 is a conventional strand withdrawal unit 2 containing driven rolls 3 and non-driven rolls 3'. The driven rolls 3 of the withdrawal unit or device 2 are driven by any suitable drive motor generally indicated by reference character 50. The first zone 4 of such strand guide arrangement or roller apron 30 is composed of a cooling grid 5 or equivalent structure and a section 6 of the strand guide arrangement which contains a number of roll pairs 34. This first zone or portion 6 of the strand guide arrangement 30 is mounted by means of support journals 7 in supports or bushings 8, or equivalent structure, of a support arm 10 fixed to the support structure 9 of the strand guide arrangement or roller apron 30.

Molten steel is teemed into the continuous casting mold 1, and a partially solidified strand 11 is continuously withdrawn out of the continuous casting mold 1, by the action of the driven rolls 3. The withdrawn strand 11 is guided and supported within the strand guide arrangement or roller apron 30 in conventional fashion.

Now if the strand 11 is deformed, and assuming that such deformations hinder undisturbed outfeed or withdrawal of such strand 11 and produce forces directed opposite to the strand withdrawal direction, or if it is assumed that the strand has become welded or otherwise unintentionally connected with parts of the strand guide arrangement 30, for instance with the cooling grid 5, due to break-out of steel which has solidified at such parts of the strand guide arrangement, whereby the strand 11 is rendered immobile, then during the strand withdrawal operation, when working with conventional strand withdrawal units, there results slippage of the pinch rolls thereof. If there are provided large dimensioned strand withdrawal units then such is avoided, and there can be transmitted the forces needed for breaking the interconnection between the strand and the strand guide arrangement entirely to the strand 11.

By means of suitable sensors or feelers, such as strain gauges 12, mounted at the top side (traction side) of the support arm 10 there can be detected the traction forces or stresses which arise thereat, the measured values can be transmitted by means of a line 13 to a conventional measuring and regulating device 14 and there compared with predetermined maximum values which are below those values which could lead to plastic deformation of the support construction or structure 9. In the event that the resistance of the seized or deformed strand 11 is so great that the forces which must be applied exceed such maximum values, then the control and regulating device 14 delivers a command, in the form of a suitable command signal or pulse, for interrupting the strand withdrawal operation. In this way there is avoided damage to the elements or parts of the strand guide arrangement or roller apron 30. The measuring and regulating device 14 can have the reference maximum values set at a reference input, indicated by reference character 40, and at the measuring and regulating device 14, which may embody any conventional comparator, the measured values are compared with the set reference values, and upon exceeding such set reference values, the output signal of the measuring and regulating device 14, in the form of a control pulse, can be used to turn-off the drive 50 of the driven rolls 3 of the strand withdrawal unit 2. Of course, instead of interrupting the strand withdrawal operation by such command signal, it is equally possible to generate an optical and/or acoustical alarm signal, calling the attention of the operator to a possible overload situation and requiring him to take appropriate corrective action. Equally, it is to be understood that feelers or sensors other than the exemplary discussed strain gauges 12 can be employed, there being suitable other measuring devices which detect forces or stresses, such as, by way of example, load cells.

Furthermore, the arrangement of the strain gauges 12 or the equivalent sensors, is not limited in any way to the top surface of the support arm 10 of the first zone 4 of the secondary cooling zone, rather can be randomly positioned at all locations where overloading of parts of the strand guide arrangement and/or strand guide elements could lead to damage thereof. Thus, for instance, all of the guide roll pairs can be protected against overload by bowed-out strands in this way. When encountering threatening overload situations it is possible to control, for instance, application of the rolls with the aid of the above-described overload safety system. Also, other geometric deviations in the continuous casting installation, which could lead to damage of the equipment, caused by extreme thermal distortions, can be detected and indicated, and thus, there can be undertaken appropriate counter measures. It is here furthermore mentioned that the invention is in no way solely limited to a continuous casting installation for the casting of slabs, as the same has been shown purely by way of example in the drawing, rather can be employed in conjunction with random types of continuous casting equipment working with open-ended molds.

While there are shown and described present preferred embodiments of the invention, it is to be distinctly understood that the invention is not limited thereto, but may be otherwise variously embodied and practiced within the scope of the following claims. Accordingly,

What I claim is:

1. A method of avoiding damage to strand guide elements of a strand guide arrangement of a continuous casting installation for metals, especially steel, due to metal break-out, comprising the steps of:

continuously casting a strand in a continuous casting mold;

guiding and supporting the continuously cast strand at a strand guide arrangement;

withdrawing the cast strand out of the continuous casting mold and through the strand guide arrangement;

determining at preselected locations of the strand guide arrangement the withdrawal forces which are effective thereat during the strand withdrawal operation owing to strands which have undesirably welded with parts of the strand guide arrangement due to metal which has spilled-out;

deriving from such determination measured values;

comparing the measured values with predetermined maximum values which prevent damage to the strand guide arrangement; and when during such comparison step the measured values exceed the predetermined maximum values generating a command for interrupting the strand withdrawal operation.

2. The method as defined in claim 1, further including the steps of:

providing a support arm for a first zone of the strand guide arrangement; and measuring the stresses arising at the support arm of the first zone of the strand guide arrangement for deriving said measured values which are compared with the predetermined maximum values.

3. A method of preventing damage to the strand guide elements of a strand guide arrangement of a continuous casting installation for metals, especially steel, due to metal break-out, comprising the steps of:

determining at least at one predetermined location along a strand guide arrangement the withdrawal forces acting at said predetermined location, during withdrawal of the strand from the strand guide arrangement, owing to the presence of a strand which has been welded undesirably to parts of the strand guide arrangement due to spill-out of the metal which is being cast;

deriving at least one measured value from the detected withdrawal forces;

comparing said measured value with at least one predetermined reference value which avoids damage to the strand guide arrangement; and discontinuing the withdrawal of the strand from the strand guide arrangement when the measured value exceeds the reference value.

4. The method as defined in claim 3, wherein:

the step of discontinuing the withdrawal of the strand is accomplished by generating a pulse for interrupting the withdrawal of the strand from the strand guide arrangement when the measured value exceeds the reference value.

* * * * *